US005094062A

United States Patent [19]

Clark

[11] Patent Number: 5,094,062

[45] Date of Patent: Mar. 10, 1992

[54] FLEX REIN

[76] Inventor: Bridget L. Clark, 642 Rivermoor Cir., Waterford, Wis. 53185

[21] Appl. No.: 570,563

[22] Filed: Aug. 21, 1990

[51] Int. Cl.[5] ..... B68B 1/00

[52] U.S. Cl. ..... 54/71; 54/16; 54/36

[58] Field of Search ..... 54/14, 15, 16, 36, 71

[56] References Cited

U.S. PATENT DOCUMENTS 64,970 5/1867 Graham ..... 54/36
305,604 9/1884 Kelley ..... 54/16 X
1,240,304 9/1917 Britt ..... 54/36
2,426,716 9/1947 Telford ..... 54/36
4,304,193 12/1981 Madden ..... 54/71 X

*Primary Examiner*—Robert P. Swiatek
*Attorney, Agent, or Firm*—Wheeler Law Firm

[57] ABSTRACT

A training mechanism for training a horse to draw in its mouth substantially horizontally so that its head flexes at the poll. A strap is attached to the saddle at a level close to the level of the mouth of the horse and is slidable through an opening at the end of the bit. The other end is preferably attached to the rein at a selected location but may be held by the rider.

9 Claims, 2 Drawing Sheets

FLEX REIN

BACKGROUND OF THE INVENTION

The instant invention relates to a mechanism to be used for the training of horses. When a horse is reined, the desired motion is for the horse to flex its head at the poll rather than the withers. However, horses do not always make the desired motion when reined and a training mechanism to teach the horse to make the desired motion is necessary. Previous training mechanisms have tended to cause the horse's head to bend at the withers which results in an undesirable downward movement of the horse's head.

An example of prior art is disclosed in FIG. 1. This apparatus is commonly referred to as a draw rein used in the German Martingale style. A German Martingale is used to prevent a horse from raising its head higher than desired by restraining the horse's head movement from a leverage point located well under the head. While this mechanism effectively restrains the horse's head vertically, it trains the horse to bend at the withers when the rein is pulled. In contrast, my invention effectively controls the horse's head movement and trains the horse to make the desired head motion which is back and in, rather than downward.

By means of a unique and simple design, the instant invention causes the horse's head to pivot or flex at the poll, resulting in a generally horizontal movement of the horse's mouth inward toward the horse's body so that the poll of the horse's head remains essentially stationary. Further, the invention more closely approximates the direction of pull of conventional reins toward the withers and the rider's hands. This facilitates the horse's transition to conventional reins from the training mechanism of the invention because the horse is less aware of the change of mechanisms and leverage points. Hence, after a suitable training period using this invention, the horse will perform as desired with conventional reins.

SUMMARY OF THE INVENTION

The invention consists essentially of a conventional horse's bit, a saddle assembly, including any conventional attachments such as a girth, stirrups, etc., and first means for training the horse's head to generally flex at the poll when the first means are applied to pull the bit. The first means preferably comprise a flexible member having a pulling end, an attachment end, and an intermediate portion slidable with respect to the bit. The invention further comprises a second means located not substantially lower than the level of the bit in the horse's mouth, securing the attachment end of the first means to an attachment point located on the saddle assembly. The location of the attachment point enables force applied to the pulling end of the first means to induce the horse to draw in its head horizontally to pivot or flex at the poll as desired.

DETAILED DESCRIPTION

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention which is defined by the claims.

Figure 5:
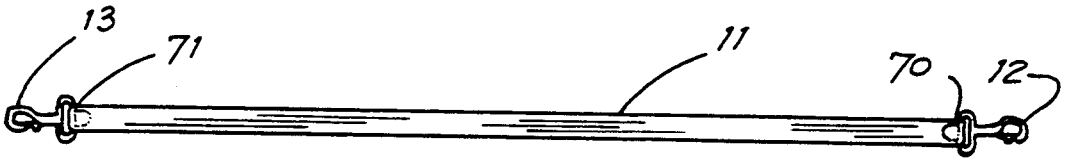
FIG. 5 is a plan view of the Flex Rein.

The Flex Rein is referred to as the unit 10 in this description. As disclosed in FIG. 2, the unit 10 is comprised of a conventional bit mechanism 30, a conventional main rein 20, and strap 11. The strap 11 has one rein attachment end 70 and one saddle attachment end 71, one rein snap 12, and one saddle snap 13. Strap 11 is a strip of leather, cotton, or nylon. Snaps 12 and 13 are conventional metal harness snaps. Rein attachment end 70 is connected to rein snap 12 as disclosed in FIG. 5. Saddle attachment end 71 is connected to saddle snap 13. Saddle snap 13 is secured to metal ring 42. Saddle assembly 80 is comprised of attachment point 40, metal ring 42, and saddle 50. Metal ring 42 is affixed to the saddle 50 at attachment point 40. Attachment point 40 is located on the saddle 50 and is generally level with conventional bit mechanism 30 located in the horse's mouth 62. The level is very important, as the location of attachment point 40 enables pulling force applied to main rein 20 by the rider to cause the horse's mouth 62 to move inward about the poll 60 rather than about the withers 61.

Figure 1:
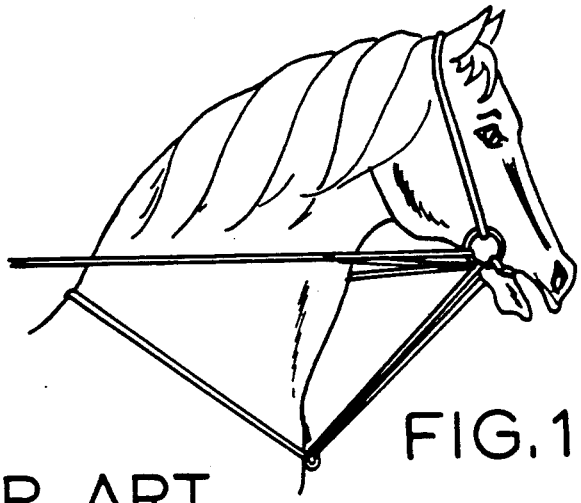
FIG. 1 PRIOR ART
FIG. 1 is a side view of prior art which is referred to as a draw rein used in the German Martingale style.
Figure 2:
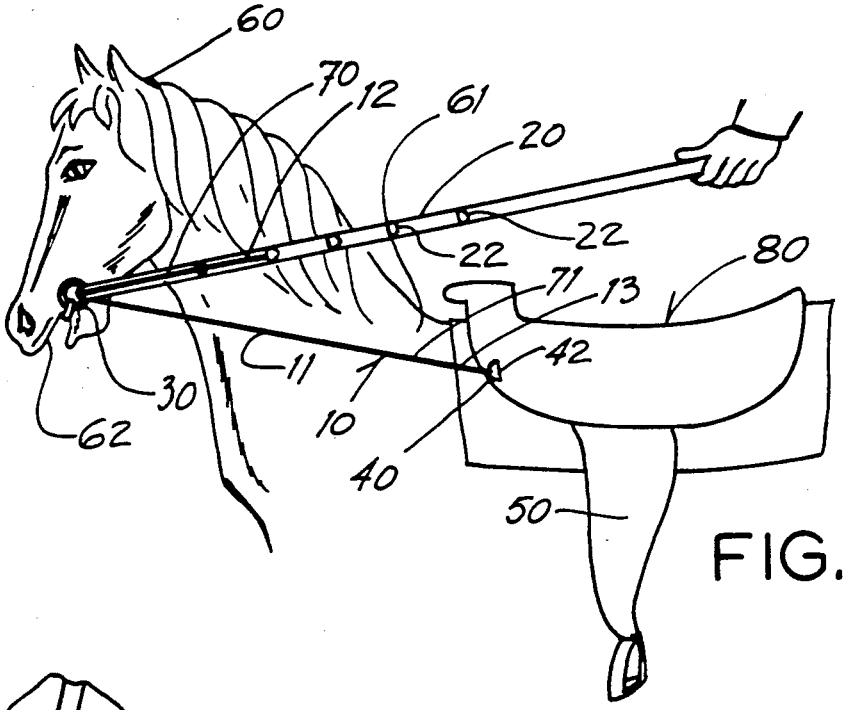
FIG. 2 is a side view of the Flex Rein attached to a conventional main rein and a conventional saddle as the invention would be used on a horse.
Figure 3:
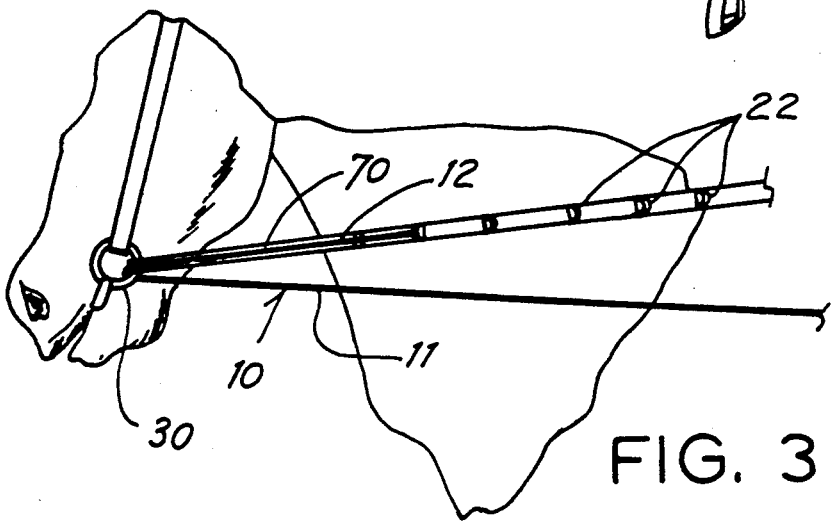
FIG. 3 is a side view of the Flex Rein showing it as it would slide through a conventional bit mechanism.
Figure 4:
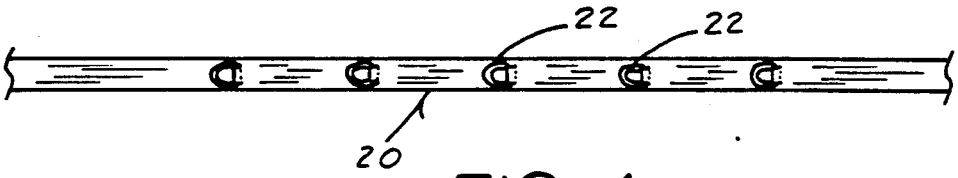
FIG. 4 is a plan view of a conventional main rein with rings inserted for attachment to the Flex Rein.

As disclosed in FIGS. 2 and 3, strap 11 is positioned so that it slides through bit mechanism 30. Rein attachment end 70 of strap 11 is attached to conventional main rein 20 through the use of rein snap 12 and a ring 22. FIGS. 2, 3 and 4 disclose a plurality of rings 22 which are affixed to main rein 20. Connecting rein snap 12 to different rings 22 enables the length of unit 10 to be adjusted as desired. Other adjustment devices may be used.

Figure 6:
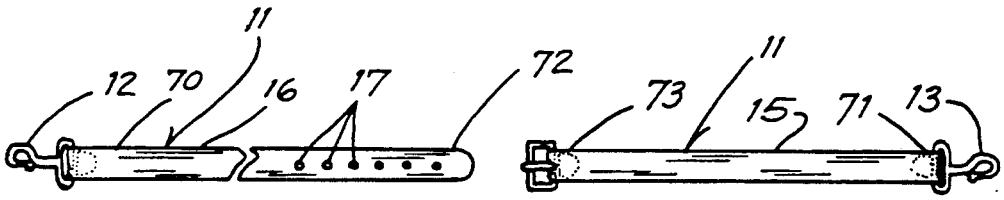
FIG. 6 is a plan view of a flexible member which is adjustable in length.

FIG. 6 discloses an alternative method for adjusting the length of strap 11. A conventional buckle mechanism 14 is used near the saddle in conjunction with leather strap portions 15 and 16. Buckle mechanism 14 is attached to buckle strap 15 at buckle attachment end 73. Saddle snap 13 is connected to buckle strap portion 15 at saddle attachment end 71. Strap 16 is connected to rein snap 12 at rein attachment end 70. Strap 16 is perforated for a short distance longitudinally near strap end 72. These perforations 17 enable the buckle mechanism 14 to link buckle strap 15 and strap 16. Portion 16, which slides through a ring at the bit, must be long enough so that the buckle does not contact the bit.

The preferred embodiment of the invention operates in the following manner: When the rider pulls the reins of the horse, some of this force is transferred from main rein 20 to strap 11 through the rein snap 12 to ring 22 connection which is located at rein attachment end 70. Because saddle attachment end 71 of strap 11 is affixed to saddle assembly 80 by means of the connection between metal ring 42 and saddle snap 13, strap 11 slides through bit mechanism 30 as the reining force is applied. This sliding action decreases the distance between saddle attachment point 40 and bit mechanism 30 and the reining force causes the horse to draw in its head. The location of attachment point 40 may vary on saddle assembly 80, depending on the horse and on the saddle style, but is at a level not substantially lower than the location of the bit in the horse's mouth. This location ensures that the horse's head pivots about the poll as desired with the horse's mouth being drawn inward in a substantially horizontal direction toward the horse's withers.

While the preferred embodiment of the invention may be adjusted in length by attaching rein snap 12 to one of rings 22, the alternative embodiment adds further means for adjusting the length of the unit 10. The buckle mechanism 14 may be connected to one of perforations 17. Connecting buckle mechanism 14 to a perforation 17 which is located proximate to strap end 72 results in a relatively long unit 10, while connection to a perforation 17 located closer to rein attachment end 70 yields a relatively short unit 10. This length adjustment enables the invention to be used effectively on horses of various sizes. These and other benefits of the present invention will be clear to one skilled in the art. Although only one side is illustrated, the draw rein of my invention is to apply the training force to the bit in a symmetrical way on each side of the horse's head, and so would be duplicated on each side or made symmetrical in action.

For the purpose of the following claims, a saddle assembly is defined as including any type of saddle or its general equivalent, including girths, stirrups or any structures or mechanisms located on or attached to a saddle or its general equivalent.

The above described embodiments of this invention are merely descriptive of its principles and are not to be limiting. The scope of this invention instead shall be determined from the scope of the following claims, including their equivalents.

What is claimed is:

1. A training mechanism for training a horse to draw in its mouth in a substantially horizontal direction toward the horse's withers so that the horse's head flexes at the poll when reined, comprising:

a bit;

a saddle assembly;

first means for training a horse's head to generally flex at said poll when said first means are applied to pull said bit;

said first means comprising a flexible member having a pulling end attached to one end of a rein, an attachment end, and an intermediate portion slidably attached to said bit;

second means located not substantially lower than the level of said bit in the horse's mouth securing said attachment end of said first means to an attachment point located on said saddle assembly.

2. The device of claim 1 in which said first means is a leather flexible member which is adjustable in length.

3. The device of claim 1 in which said first means is a leather flexible member with conventional harness snaps attached to both ends.

4. The device of claim 1 in which said first means is a cotton flexible member.

5. The device of claim 1 in which said first means is a nylon flexible member.

6. The device of claim 1 in which said second means is a conventional harness snap which snaps onto a ring affixed to said saddle assembly.

7. A training mechanism for training a horse to draw in its mouth in a substantially horizontal direction toward the horse's withers so that the horse's head flexes at the poll when the horse is reined, comprising:

a bit;

a saddle assembly;

reins attached to the bit;

a plurality of first means for training the horse's head to generally flex at said poll when said first means are applied to pull said bit;

each said first means comprising a flexible member having a pulling end, an attachment end, and an intermediate portion slidable with respect to said bit;

second means for securing said attachment end of said first means to an attachment point located on said saddle assembly, said attachment point being located not substantially lower than the level of said bit in the horse's mouth;

said pulling end being attached to in one of said reins.

8. The device of claim 7 in which the place at which said pulling end is attached to said rein may be moved along said rein.

9. A training mechanism for training a horse to draw in the horse's mouth in a substantially horizontal direction toward the horse's withers so that the horse's head flexes at the poll when reined, the improvement comprising:

a bit having ends;

reins;

a saddle assembly having attachment rings secured at locations that will not be substantially lower than the mouth of the horse when the saddle is on the horse;

a plurality of flexible members which are adjustable in length for training the horse's head to generally flex at said poll when said flexible members are applied to pull said bit;

said flexible members each having a pulling end, an attachment end, and an intermediate slidable portion;

each said slidable portion being slidably engaged with an end of said bit;

said attachment end consisting essentially of a conventional harness snap which snaps onto a ring affixed to said saddle assembly;

each said pulling end of each said flexible member being attached to one of said reins.

* * * * *